US005263719A

United States Patent [19]

Bunn

[11] Patent Number: 5,263,719

[45] Date of Patent: Nov. 23, 1993

[54] GOLF CLUB SWING TRAINING DEVICE

[76] Inventor: John B. Bunn, 3004 Randolph Dr., Raleigh, N.C. 27609

[21] Appl. No.: 956,160

[22] Filed: Oct. 5, 1992

[51] Int. Cl.[5] ..... A63B 69/36

[52] U.S. Cl. ..... 273/186.1; 273/191 R

[58] Field of Search ..... 273/191 R, 191 A, 191 B, 273/192, 186.1, 186.2, 187.4; 434/252

[56] References Cited

U.S. PATENT DOCUMENTS 4,765,624 8/1988 Sprague ..... 273/192

*Primary Examiner*—George J. Marlo

*Attorney, Agent, or Firm*—Rhodes, Coats & Bennett

[57] ABSTRACT

A golf practice aid having a pair of upstanding converging side walls and a top extending outwardly over the converging side walls. This structure forms an outwardly open golf head tunnel or passageway. In use, the ball is set just outside the exiting end of the tunnel and the golfer is required to swing the golf club head under the top and adjacent the converging side walls of the practice aid before the club impacts the ball. This requires the golfer to maintain a proper stance in order to maintain eye contact with the ball and further requires the golfer to swing down and under the ball and to maintain the path of the golf club in line with the proper flight of the ball.

4 Claims, 3 Drawing Sheets

GOLF CLUB SWING TRAINING DEVICE

FIELD OF INVENTION

The present invention relates to golf practicing aids and more particularly to golf practicing aids designed to develop a proper stance and swing, and more particularly to a golf practicing aid that compels a club head swing through an obstacle.

BACKGROUND OF THE INVENTION

The popularity of the game of golf is at an all-time high today. Golf is one of the most popular, if not the most popular sport in the United States and is enjoyed worldwide.

It becomes more apparent everyday that golfers take their game very seriously. As a part of that seriousness they practice and work very diligently on various parts of the game that will in the end improve their score and make them a better golfer. Golf is the type of game where even the best players strive for improvement and continue to practice and work on their game. Because of this, the golf industry has seen an explosion of golf practice aids over the last decade. There are many new practice aids introduced into the marketplace each year that are aimed at assisting a golfer in improving his or her game.

One particular area that receives a great deal of attention from the golfer is in the areas of improving the golfer's stance and swing. It is well-appreciated by golf teaching pros and golf experts alike that it is most important to be able to maintain a proper swing and stance if the ball is to maintain an accurate flight to the hole or target.

First, with respect to stance, it is a common mistake or habit of golfers to move their head back during the course of the backswing or forward swing. This results in the golfer's body being out of position and the result is that the golf ball is not impacted solidly. There has been and continues to be a need for a golf practicing aid that teaches and encourages the golfer to maintain his head in a proper position with respect to the ball during both the backswing and the forward swing.

Next, it is quite common for golfers to execute an improper swing and to accordingly strike the golf ball in such a fashion that the ball is sliced or hit inaccurately with respect to the hole or target. One common problem is that of "coming over the ball". Essentially here the golf club head is swung outwardly past the ball and back in towards the ball such that when impact occurs the golf club head is not moving in the direction of the projected flight of the ball. This often results in "slice".

Therefore, there is and continues to be a need for a golf practicing aid that assists the golfer in helping develop a stance where the golfer maintains eye contact with the ball throughout his or her swing. There also is a need for a golf practicing aid that helps a golfer develop a proper swing such that the golf club head does not swing out and back over the ball but that the club is maintained in an "inside" swing pattern such that the golf club head upon impact is moving in the direction of the target or the hole.

SUMMARY AND OBJECTS OF THE INVENTION

The present invention entails a golf practicing aid that is designed to help a golfer improve both his stance and swing. In particular, the device of the present invention entails a pair of side walls that support a flat top thereabove. About one end of the device the side walls converge to a point while the top extends over the converging wall. This forms a golf head passageway underneath the top and adjacent the side walls. In use, the ball is spotted just outside the golf club passageway about the exiting end thereof. Consequently, the golf club head passageway or tunnel constrains the golf club head to be swung in a path where the club is swung downwardly and passes under the top of the practicing aid and adjacent the converging side wall and whereupon the golf club head impacts the ball just as it passes the terminal edge of the top. Obviously, if the club head engages the practice aid then the golfer has executed an improper swing. Also, if the golfer moves his or her head back then the top of the golf practice aid will interfere with the line of sight and the golfer will not be able to maintain eye contact with the golf ball throughout his or her swing.

It is therefore an object of the present invention to provide a golf practicing aid that addresses both the golfer's stance and his swing.

Another object of the present invention is to provide an obstacle type golf practice aid that constrains the golfer to move the golf club head through a proper swing path or engage the obstacle.

It is also an object of the present invention to construct the golf practice aid of a material such as cardboard that can be impacted without damaging the golf club.

Still a further object of the present invention is to provide an obstacle type golf practicing aid that defines a club head pathway for executing a proper swing and wherein in the course of utilizing the golf practicing aid of the present invention the golf club head is swung so as to pass through this golf club head pathway.

Still a further object of the present invention resides in the provision of a golf practicing aid that is disposed adjacent the golf ball during use such that when the golfer moves his head back then the golfer loses sight of the ball indicating an improper stance or movement.

It is also an object of the present invention to produce a golf practicing aid of the character referred to above that is simple and light in construction and which is relatively inexpensive.

Still a further object of the present invention resides in the provision of a golf practicing aid for helping golfers develop and improve their stance and/or swing wherein the golf practicing aid can be utilized by golfers of all skill levels.

A further object of the present invention resides in the provision of a golf practicing aid of the character referred to above that is compatible for both left and right handed golfers.

Other objects and advantages of the present invention will become apparent and obvious from a study of the following description and the accompanying drawings which are merely illustrative of such invention.

DETAILED DESCRIPTION OF THE INVENTION

Figure 1:
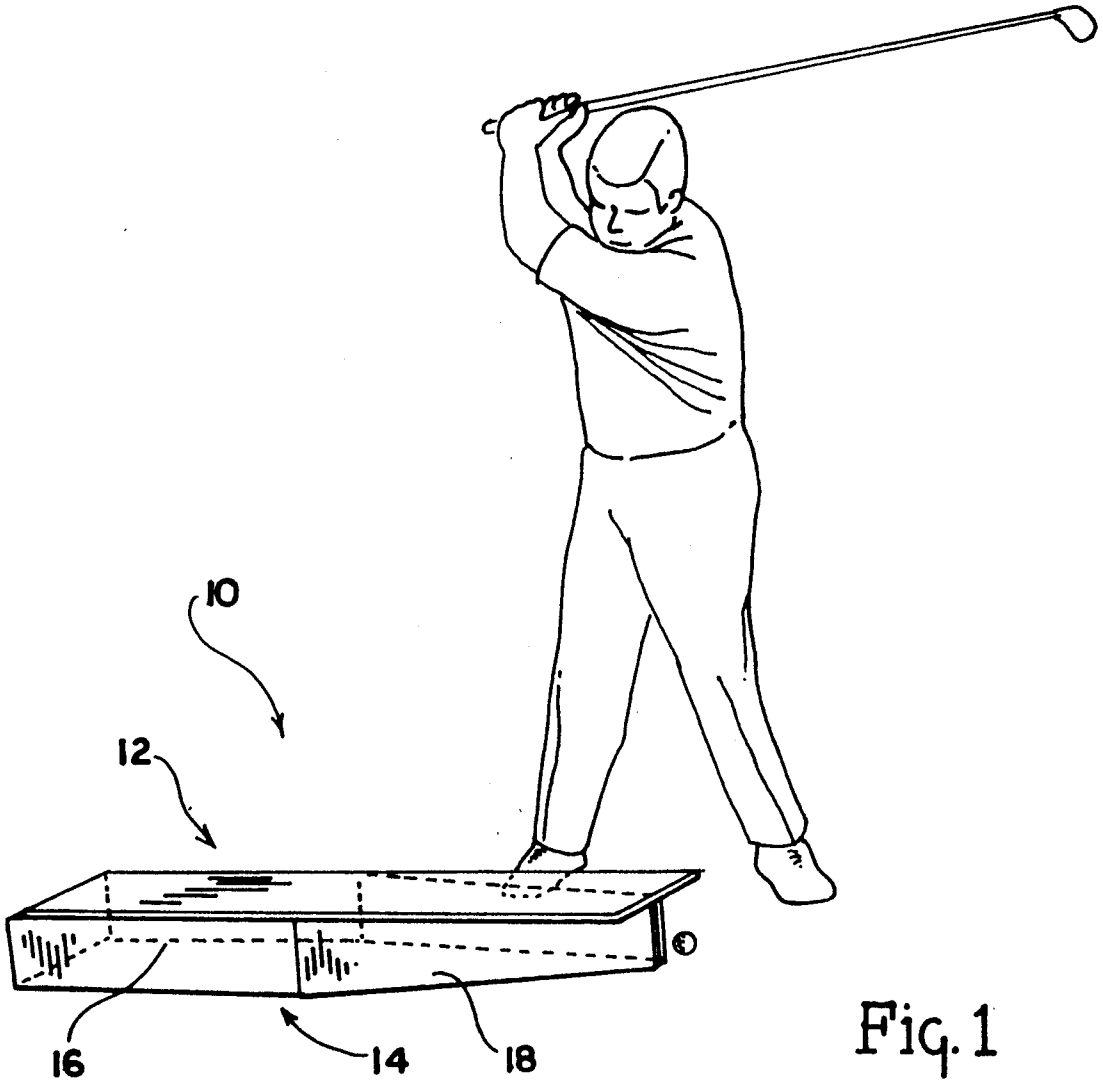
FIG. 1 is a perspective view of the golf practicing aid of the present invention showing a golfer utilizing the same.

With further reference to the drawings, the golf practice aid of the present invention is shown therein and indicated generally by the numeral 10. Viewing the golf practice aid 10 in detail, it is seen that the same includes a top indicated generally by the numeral 12 and a pair of upstanding side walls each indicated generally by the numeral 14. The pair of side walls 14 include a first pair of parallel side walls 16 that extend from a distant end of the golf practicing aid to a general mid point area of the same. From the mid point area the side retaining walls converge and form a pair of converging side walls 18 that converge to form a ball end of the golf practicing aid 10.

Golf practicing aid 10 can be constructed of many different types of material. But in a preferred embodiment it is contemplated for purposes of economy and practicality that a cardboard construction would be appropriate as well as economical.

Figure 2:
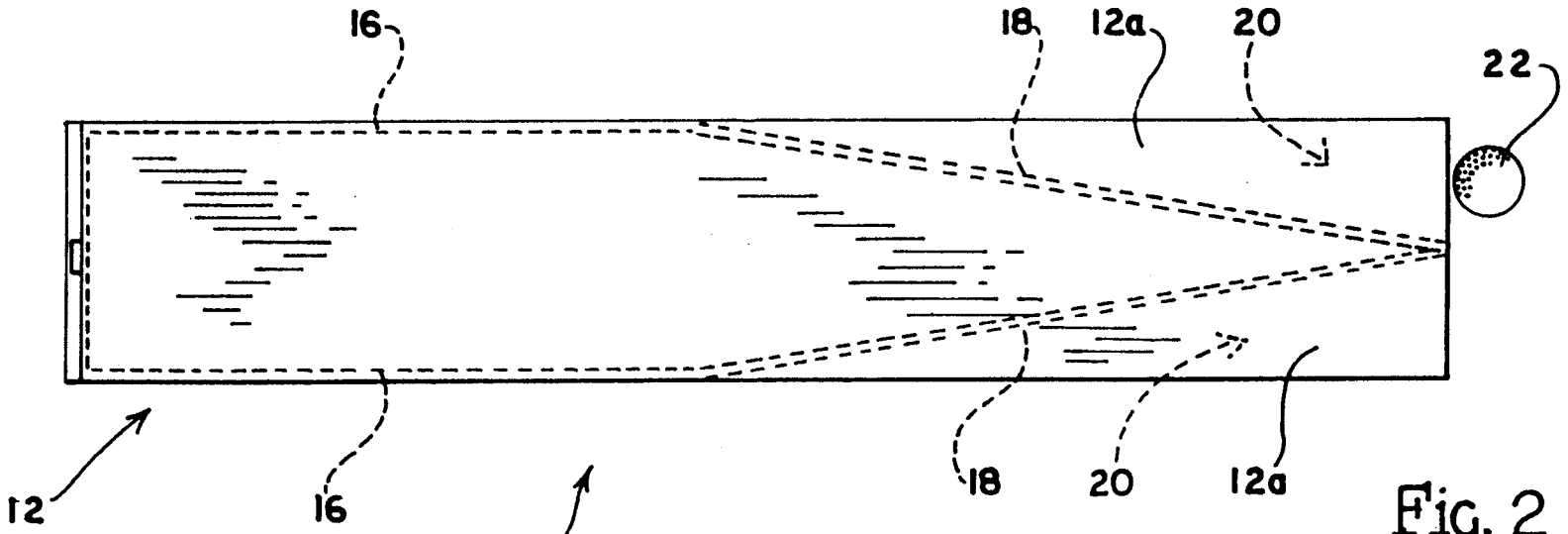
FIG. 2 is a top plan view of the golf practicing aid.
Figure 3:
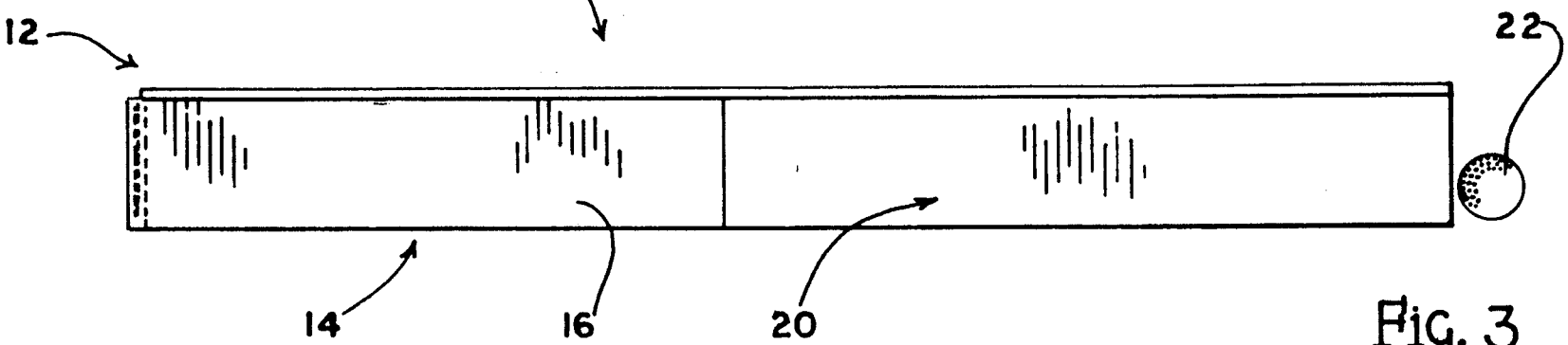
FIG. 3 is a side elevational view of the golf practice aid of the present invention.
Figure 4:
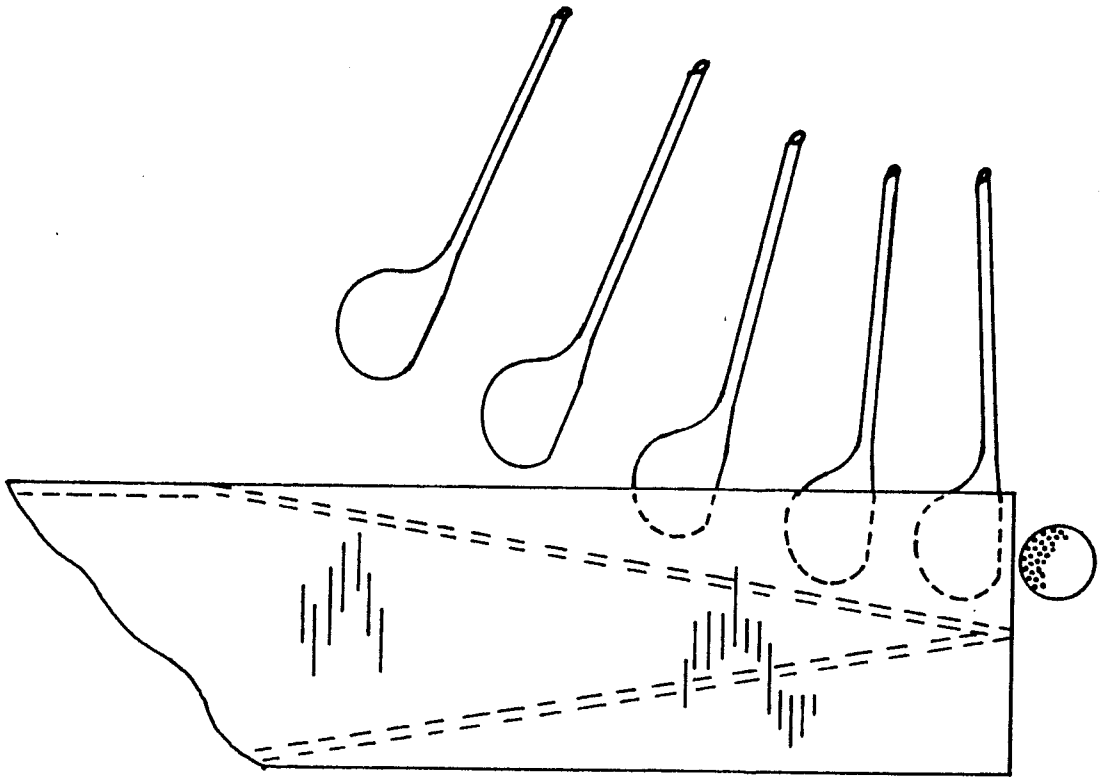
FIG. 4 is a fragmentary plan view of the golf practice aid showing the movement of a golf club through the formed passageway.

An important part of the present invention revolves around the structure formed by the top 12 and the converging side walls 18. It is appreciated that the top 12 extends outwardly over the converging side walls 18 and as illustrated in FIG. 2 the top 12 and converging side walls 18 form a club head passageway 20. As seen in FIG. 1, it is appreciated that the converging side wall 18 facing the golfer moves outwardly away from the golfer as it extends towards the ball 22. Thus, it is appreciated that in using the golf practicing aid 10 of the present invention that in a properly executed swing the club head will move downwardly and pass underneath the top portion 12*a* that extends outwardly over the converging sides 18. As the club head passes under top portion 12*a* (FIG. 4) it is seen that it will move along the side converging side retaining wall 18. Just as the club head exits the club passageway 20 the club head will strike the ball 22. Thus, it is appreciated that if the golfer has a tendency to come over the ball that the club head will impact against the golf practicing aid 10 and of course the golfer will then be made keenly aware of the flaw in his or her swing. But if the golfer executes a proper swing where the swing comes "under" and does not move outside the line of flight of the ball 22 then the club head will pass through the golf head passageway 20 underneath the top portion 12*a* without impacting the golf practicing aid 10 and will correctly and accurately engage and impact against the ball 22.

As illustrated in FIG. 1, it is appreciated that the golfer depicted therein can maintain eye contact with the ball 22 during his entire swing. However, if the golfer moves his head towards the rear, the top 12 of the golf practicing aid will actually interfere with the golfer's sight of the ball and the golfer will in fact lose sight of the ball or a portion thereof. Thus, during practice a golfer will appreciate whether his head is being maintained in a proper upright posture or being moved towards the rear.

The golf practicing aid of the present invention can be constructed of various suitable material but it is contemplated that in a preferred embodiment the golf practicing aid 10 would be constructed of cardboard or the like. In addition, it should be appreciated that the golf practicing aid of the present invention could be shortened and some form of anchoring means can be associated with the device such that it can be anchored to the ground during use.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A golf practice aid for assisting a golfer in developing a proper inside swing comprising: an elongated structure including a pair of sides, a top and a pair of ends including a converging end; and wherein the sides are spaced apart but extend in a converging fashion towards the converging end and wherein the top extends outwardly over the converging sides to form a club passing underneath the top and along the converging sides, and wherein the width of the defined club passing area varies and becomes wider from an intermediate area of the elongated structure towards the converging end; and wherein the structure is utilized to assist in developing a proper inside swing by placing a golf ball adjacent the converging end of the structure so as to require the golf club to be swung in a fashion such that the golf club head is required to pass underneath the top of the structure and to move outwardly away from the golfer along the converging sides before the golf club head strikes the ball.

2. The golf practice aid of claim 1 wherein the structure is made of cardboard.

3. The golf practice aid of claim 1 wherein the to of the elongated structure is of a generally constant width from one end of the structure to the other end.

4. A golf practicing aid for assisting golfers in developing a proper stance and swing comprising: an elongated structure having a pair of upstanding side walls, a top support above the upstanding side walls, a distant end and a ball end that lies adjacent the lay of the ball during use, the top being of a general uniform width from one end to the other end while the side walls are laterally spaced from the distant end to generally a midpoint area of the structure where the side walls thus taper inwardly towards the ball end; and wherein the top extends outwardly over the converging side walls about the ball end of the structure to form a club head passing area on each side of the converging side walls underneath the top and wherein the width of defined club passing area varies and becomes progressively wider from the generally midpoint area of the structure to the ball end.

* * * * *